US008328960B2

(12) United States Patent
Gomez et al.

(10) Patent No.: US 8,328,960 B2
(45) Date of Patent: Dec. 11, 2012

(54) HIGH STRENGTH BAINITIC STEEL FOR OCTG APPLICATIONS

(75) Inventors: Gonzalo Roberto Gomez, Buenos Aires (AR); Teresa Estela Pérez, Buenos Aires (AR); Harsad Kumar Dharamshi Hansraj Bhadeshia, Cambridge (GB)

(73) Assignee: Tenaris Connections Limited, Kingstown (VC)

( * ) Notice: Subject to any disclaimer, the term of this patent is extended or adjusted under 35 U.S.C. 154(b) by 183 days.

(21) Appl. No.: 12/743,801

(22) PCT Filed: Nov. 19, 2007

(86) PCT No.: PCT/EP2007/062492

§ 371 (c)(1), (2), (4) Date: Aug. 9, 2010

(87) PCT Pub. No.: WO2009/065432

PCT Pub. Date: May 28, 2009

(65) Prior Publication Data

US 2010/0294401 A1 Nov. 25, 2010

(51) Int. Cl.

| | |
|---|---|
| ***C22C 38/44*** | (2006.01) |
| ***C21D 8/10*** | (2006.01) |
| ***C21D 9/08*** | (2006.01) |

(52) U.S. Cl. ..... 148/335; 148/320; 148/909; 148/590; 148/593; 148/663; 148/653

(58) Field of Classification Search ..... 148/320, 148/330–336, 909, 590, 593, 663, 653; 420/104–128
See application file for complete search history.

(56) References Cited

U.S. PATENT DOCUMENTS

| | | | | |
|---|---|---|---|---|
| 3,655,465 | A | | 4/1972 | Snape et al. |
| 3,810,793 | A | | 5/1974 | Heller |
| 3,915,697 | A | * | 10/1975 | Giuliani et al. ..... 420/90 |
| 4,231,555 | A | | 11/1980 | Saito |
| 4,336,081 | A | | 6/1982 | Hijikata et al. |
| 4,376,528 | A | | 3/1983 | Ohshimatani et al. |
| 4,379,482 | A | | 4/1983 | Suzuki et al. |
| 4,407,681 | A | | 10/1983 | Ina et al. |

(Continued)

FOREIGN PATENT DOCUMENTS

AR 0050159 A1 10/2006

(Continued)

OTHER PUBLICATIONS

Chang, L.C., "Microstructures and reaction kinetics of bainite transformation in Si-rich steels," XP0024874, Materials Science and Engineering, vol. 368, No. 1-2, Mar. 15, 2004, pp. 175-182, Abstract, Table 1.

(Continued)

*Primary Examiner* — Deborah Yee
(74) *Attorney, Agent, or Firm* — Knobbe Martens Olson & Bear, LLP

(57) ABSTRACT

A high strength bainitic steel and a process for producing seamless pipes for OCTG applications are described. In particular, the advantages ensuing to the steel of the invention are the improvement in strength-toughness over tempered martensitic steels, and a simplified thermal treatment. Quenching is not necessary and by avoiding the quenching treatment the microstructure results far more homogeneous, which allows thick walled tubes to be produced. For the same steel composition, in comparison to conventional tempered martensitic structures, a better combination of strength and toughness can be achieved, in particular by tempering as rolled carbide-free bainitic structures.

23 Claims, 6 Drawing Sheets

U.S. PATENT DOCUMENTS

| | | | |
|---|---|---|---|
| 4,526,628 | A | 7/1985 | Ohno et al. |
| 4,721,536 | A | 1/1988 | Koch et al. |
| 4,814,141 | A | 3/1989 | Imai et al. |
| 5,352,406 | A | 10/1994 | Barteri et al. |
| 5,454,883 | A | 10/1995 | Yoshie et al. |
| 5,538,566 | A | 7/1996 | Gallagher |
| 5,592,988 | A | 1/1997 | Meroni et al. |
| 5,598,735 | A | 2/1997 | Saito et al. |
| 5,944,921 | A | 8/1999 | Cumino et al. |
| 5,993,570 | A | 11/1999 | Gray |
| 6,030,470 | A | 2/2000 | Hensger et al. |
| 6,188,037 | B1 | 2/2001 | Hamada et al. |
| 6,196,530 | B1 | 3/2001 | Muhr et al. |
| 6,217,676 | B1 | 4/2001 | Takabe et al. |
| 6,267,828 | B1 | 7/2001 | Kushida et al. |
| 6,311,965 | B1 | 11/2001 | Muhr et al. |
| 6,384,388 | B1 | 5/2002 | Anderson et al. |
| 6,648,991 | B2 | 11/2003 | Turconi et al. |
| 6,669,285 | B1 | 12/2003 | Park et al. |
| 6,669,789 | B1 | 12/2003 | Edelman et al. |
| 6,682,610 | B1 | 1/2004 | Inoue |
| 6,767,417 | B2 | 7/2004 | Fujita et al. |
| 6,958,099 | B2 | 10/2005 | Nakamura et al. |
| 7,074,283 | B2 | 7/2006 | Omura |
| 7,083,686 | B2 | 8/2006 | Itou |
| 7,264,684 | B2 | 9/2007 | Numata et al. |
| 7,635,406 | B2 | 12/2009 | Numata et al. |
| 7,744,708 | B2 | 6/2010 | López et al. |
| 7,862,667 | B2 | 1/2011 | Turconi et al. |
| 8,002,910 | B2 | 8/2011 | Tivelli et al. |
| 8,007,601 | B2 | 8/2011 | López et al. |
| 8,007,603 | B2 | 8/2011 | Garcia et al. |
| 2002/0011284 | A1 | 1/2002 | Von Hagen et al. |
| 2003/0116238 | A1 | 6/2003 | Fujita |
| 2003/0155052 | A1 | 8/2003 | Kondo et al. |
| 2004/0118490 | A1 | 6/2004 | Klueh et al. |
| 2004/0131876 | A1 | 7/2004 | Ohgami et al. |
| 2004/0139780 | A1 | 7/2004 | Cai et al. |
| 2005/0076975 | A1 | 4/2005 | Lopez et al. |
| 2005/0087269 | A1 | 4/2005 | Merwin |
| 2006/0124211 | A1 | 6/2006 | Takano et al. |
| 2006/0169368 | A1 | 8/2006 | Lopez et al. |
| 2006/0243355 | A1 | 11/2006 | Haiderer et al. |
| 2007/0089813 | A1 | 4/2007 | Tivelli |
| 2007/0137736 | A1 | 6/2007 | Omura et al. |
| 2007/0216126 | A1 | 9/2007 | Lopez et al. |
| 2008/0047635 | A1 | 2/2008 | Kondo et al. |
| 2008/0129044 | A1 | 6/2008 | Carcagno et al. |
| 2008/0219878 | A1 | 9/2008 | Kondo et al. |
| 2008/0226396 | A1 | 9/2008 | Garcia et al. |
| 2008/0226491 | A1 | 9/2008 | Satou et al. |
| 2008/0314481 | A1 | 12/2008 | Garcia et al. |
| 2009/0010794 | A1 | 1/2009 | Turconi et al. |
| 2009/0101242 | A1 | 4/2009 | Lopez et al. |
| 2010/0068549 | A1 | 3/2010 | Agazzi |
| 2010/0136363 | A1 | 6/2010 | Valdez et al. |
| 2010/0193085 | A1 | 8/2010 | Garcia |
| 2010/0294401 | A1 | 11/2010 | Gomez |
| 2010/0319814 | A1 | 12/2010 | Perez |
| 2010/0327550 | A1 | 12/2010 | Lopez |
| 2011/0097235 | A1 | 4/2011 | Turconi et al. |

FOREIGN PATENT DOCUMENTS

| | | | |
|---|---|---|---|
| CN | 101613829 | A | 12/2009 |
| EP | 0 092 815 | | 11/1983 |
| EP | 0 658 632 | | 6/1995 |
| EP | 0 753 595 | | 1/1997 |
| EP | 0 828 007 | A | 3/1998 |
| EP | 0 989 196 | A | 3/2000 |
| EP | 01027944 | B1 | 8/2000 |
| EP | 1 277 848 | A | 1/2003 |
| EP | 1 288 316 | | 3/2003 |
| EP | 1 413 639 | | 4/2004 |
| EP | 1 717 324 | | 11/2006 |
| EP | 2 028 284 | | 2/2009 |
| JP | 60-086209 | | 5/1985 |
| JP | 36025719 | | 10/1985 |
| JP | 61270355 | | 11/1986 |
| JP | 63004046 | A2 | 1/1988 |
| JP | 63004047 | A2 | 1/1988 |
| JP | 63230847 | A2 | 9/1988 |
| JP | 63230851 | A2 | 9/1988 |
| JP | 01 259124 | A2 | 10/1989 |
| JP | 01 259125 | A2 | 10/1989 |
| JP | 01 283322 | A2 | 11/1989 |
| JP | 05-098350 | | 12/1990 |
| JP | 403006329 | A | 1/1991 |
| JP | 04 021718 | A2 | 1/1992 |
| JP | 04 107214 | | 4/1992 |
| JP | 04 231414 | A2 | 8/1992 |
| JP | 05 287381 | A2 | 11/1993 |
| JP | 06-093339 | | 4/1994 |
| JP | 06 172859 | A2 | 6/1994 |
| JP | 07 041856 | A2 | 2/1995 |
| JP | 07 197125 | A2 | 8/1995 |
| JP | 08 311551 | | 11/1996 |
| JP | 09 067624 | A2 | 3/1997 |
| JP | 09-235617 | | 9/1997 |
| JP | 10 140250 | | 5/1998 |
| JP | 10176239 | | 6/1998 |
| JP | 10 280037 | A | 10/1998 |
| JP | 11 050148 | A | 2/1999 |
| JP | 11140580 | | 5/1999 |
| JP | 11229079 | | 8/1999 |
| JP | 2000-063940 | | 2/2000 |
| JP | 2000-313919 | A2 | 11/2000 |
| JP | 2001-131698 | | 5/2001 |
| JP | 2001-164338 | | 6/2001 |
| JP | 2001-172739 | A2 | 6/2001 |
| JP | 2001-271134 | | 10/2001 |
| JP | 2002-096105 | A2 | 4/2002 |
| JP | 2004-011009 | | 1/2004 |
| JP | 60 174822 | | 9/2005 |
| KR | 0245031 | | 3/2000 |
| WO | WO 96/22396 | A | 7/1996 |
| WO | WO 00/70107 | | 11/2000 |
| WO | WO 01/88210 | | 11/2001 |
| WO | WO 03/033856 | | 4/2003 |
| WO | WO 2004/031420 | | 4/2004 |
| WO | WO 2004/097059 | A1 | 11/2004 |
| WO | WO 2007/017161 | A | 2/2007 |
| WO | WO 2008/003000 | | 1/2008 |
| WO | WO 2008/127084 | A2 | 10/2008 |
| WO | WO 2009/044297 | | 4/2009 |
| WO | WO 2010/061882 | | 6/2010 |

OTHER PUBLICATIONS

International Search Report dated Jul. 29, 2008, Application No. PCT/EP2007/062492, filed Nov. 19, 2007.

"Seamless Steel Tubes for Pressure Purposes-Technical Delivery Conditions-Part 1: Non-alloy Steel Tubes with Specified Room Temperature Properties" British Standard BS EN 10216-1:2002 E:1-26, published May 2002.

"Seamless Steel Tubes for Pressure Purposes-Technical Delivery Conditions-Part 2: Non-alloy and Alloy Steel Tubes with Specified Elevated Temperature Properties" British Standard BS EN 10216-2:2002+A2:2007:E:1-45, published Aug. 2007.

"Seamless Steel Tubes for Pressure Purposes-Technical Delivery Conditions-Part 3: Alloy Fine Grain Steel Tubes" British Standard BS EN 10216-3:2002 +A1:2004 E:1-34, published Mar. 2004.

"Seamless Steel Tubes for Pressure Purposes-Technical Delivery Conditions-Part 4: Non-alloy and Alloy Steel Tubes with Specified Low Temperature Properties" British Standard BS EN 10216-4:2002 + A1:2004 E:1-30, published Mar. 2004.

Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.

Anelli, E., D. Colleluori, M. Pontremoli, G. Cumino, A. Izquierdo, H. Quintanilla, "Metallurgical design of advanced heavy wall seamless pipes for deep-water applications", 4th International Conference on Pipeline Technology, May 9 to 13, 2004, Ostend, Belgium.

Asahi, et al., Development of Ultra-high-strength Linepipe, X120, Nippon Steel Technical Report, Jul. 2004, Issue 90, pp. 82-87.

ASM Handbook, Mechanical Tubing and Cold Finishing, Metals Handbook Desk Edition, (2000), 5 pages.
Bai M., D. Liu, Y. Lou, X. Mao, L. Li, X. Huo, "Effects of Ti addition on low carbon hot strips produced by CSP process", Journal of University of Science and Technology Beijing, 2006, vol. 13, N° 3, p. 230.
Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.
Berner, Robert A., "Tetragonal Iron Sulfide", Science, Aug. 31, 1962, vol. 137, Issue 3531, pp. 669.
Berstein et al.,"The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.
Boulegue, Jacques, "Equilibria in a sulfide rich water from Enghien-les-Bains, France", Geochimica et Cosmochimica Acta, Pergamom Press, 1977, vol. 41, pp. 1751-1758, Great Britain.
Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina.
Cancio et al., "Characterization of microalloy precipitates in the austenitic range of high strength low alloy steels", Steel Research, 2002, vol. 73, pp. 340-346.
Carboni, A., A. Pigani, G. Megahed, S. Paul, "Casting and rolling of API X 70 grades for artic application in a thin slab rolling plant", Stahl u Eisen, 2008, N° 1, p. 131-134.
Clark, A. Horrell, "Some Comments on the Composition and Stability Relations of Mackinawite", Neues Jahrbuch fur Mineralogie, 1966, vol. 5, pp. 300-304, London, England.
Craig, Bruce D., "Effect of Copper on the Protectiveness of Iron Sulfide Films", Corrosion, National Association of Corrosion Engineers, 1984, vol. 40, Issue 9, pp. 471-474.
D.O.T. 178.68 Spec. 39, pp. 831-840, Non reusable (non refillable) cylinders, Oct. 1, 2002.
De Medicis, Rinaldo, "Cubic FeS, A Metastable Iron Sulfide", Science, American Association for the Advancement of Science, Steenbock Memorial Library, Dec. 11, 1970, vol. 170, Issue 3963, pp. 723-728.
Echaniz, "The effect of microstructure on the KISSC of low alloy carbon steels", Nace Corrosion '98, EE. UU., Mar. 1998, pp. 22-27, San Diego.
Echaniz, G., Morales, C., Perez, T., "Advances in Corrosion Control and Materials in Oil and Gas Production" Papers from Eurocorr 97 and Eurocorr 98, 13, P. S. Jackman and L.M. Smith, Published for the European Federation of Corrosion, No. 26, European Federation of Corrosion Publications, 1999.
Gojic, Mirko and Kosec, Ladislav, "The Susceptibility to the Hydrogen Embrittlement of Low Alloy Cr and CrMo Steels", ISIJ International, 1997, vol. 37, Issue 4, pp. 412-418.
Heckmann, et al., Development of low carbon Nb-Ti-B microalloyed steels for high strength large diameter linepipe, Ironmaking and Steelmaking, 2005, vol. 32, Issue 4, pp. 337-341.
Howells, et al.: "Challenges for Ultra-Deep Water Riser Systems", IIR, London, Apr. 1997, 11 pages.
Hutchings et al., "Ratio of Specimen thickness to charging area for reliable hydrogen permeation measurement", British Corrosion. Journal, 1993, vol. 28, Issue 4, pp. 309-312.
Iino et al., "Aciers pour pipe-lines resistant au cloquage et au criquage dus a l'hydrogene", Revue de Metallurgie, 1979, vol. 76, Issue 8-9, pp. 591-609.
Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.
Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.
Keizer, Joel, "Statistical Thermodynamics of Nonequilibrium Processes", Spinger-Verlag, 1987.
Kish, T., H.Takeucgi, M.Yamamiya, H.Tsuboi, T.Nakano, T.Ando, "Mold Powder Technology for Continuous Casting of Ti-Stabilized Stainless Steels", Nippon Steel Technical Report, No34, Jul. 1987, pp. 11-19.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Mishael, et al., "Practical Applications of Hydrogen Permeation Monitoring," Corrosion, Mar. 28-Apr. 1, 2004, Corrosion 2004, Nacional Association of Corrosion Engineers, vol. Reprint No. 04476.
Morice et al., "Moessbauer Studies of Iron Sulphides", J. Inorg. Nucl. Chem., 1969, vol. 31, pp. 3797-3802.
Mukongo, T., P.C.Pistorius, and A.M.Garbers-Craig, "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide Ions with Metallic Iron", Geochemica et Cosmochemica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
NACE MR0175/ISO 15156-1 Petroleum and natural gas industries—Materials for use in H2S—containing Environments in oil and gas production—Part 1: General principles for selection of cracking—resistant materials, Jun. 28, 2007.
Nagata, M., J. Speer, D. Matlock, "Titanium nitride precipitation behavior in thin slab cast high strength low alloyed steels", Metallurgical and Materials Transactions A, 2002 ,vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
Pressure Equipment Directive 97/23/EC, May 29, 1997, downloaded from website:http://ec.europa.eu/enterprise/pressure_equipment/ped/index_en.html on Aug. 4, 2010.
Prevéy, Paul, et al., "Introduction of Residual Stresses to Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Tempuratures", Stockholm Contrib. Geol., 1969, vol. 26, pp. 67-95.
Riecke, Ernst and Bohnenkamp, Konrad, "Uber den Einfluss von Gittersoerstellen in Eisen auf die Wassersroffdiffusion", Z. Metallkde.., 1984, vol. 75, pp. 76-81.
Shanabarger, M.R. and Moorhead, R. Dale, "H2O Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A.Dasgupta, R.Bommaraju, "Characterization of the chemical interactions during casting of High-titanium low carbon enameling steels", 1991 Steelmaking Conference Proceeding, pp. 707-717.
Smyth, D., et al.: Steel Tublar Products, Properties and Selection: Irons, Steels, and High-Performance Alloys, vol. 1, ASM Handbook, ASM International, 1990, p. 327-336.
Spry, Alan, "Metamorphic Textures", Perganom Press, 1969, New York.
Taira et al., "HIC and SSC Resistance of Line Pipes for Sour Gas Service", Nippon Kokan Technical Report, 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris Newsletter for Pipeline Services, Apr. 2005, p. 1-8.

Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Tivelli, M., G. Cumino, A. lzquierdo, E. Anelli, A. Di Schino, "Metallurgical Aspects of Heavy Wall—High Strength Seamless Pipes for Deep Water Applications", RioPipeline 2005, Oct. 17 to 19, 2005, Rio (Brasil), Paper n° IBP 1008_05.
Todoroki, T. Ishii, K. Mizuno, A. Hongo, "Effect of crystallization behavior of mold flux on slab surface quality of a Ti-bearing Fe-Cr-Ni super alloy cast by means of continuous casting process", Materials Science and Engineering A, 2005, vol. 413-414, p. 121-128.
Vaughan, D. J. and Ridout, M.S., "Moessbauer Studies of Some Sulphide Minerals", J. Inorg Nucl. Chem., 1971, vol. 33, pp. 741-746.
Wegst, C.W., "Stahlüssel", Auflage 1989, Seite 119, 2 pages.

* cited by examiner

HIGH STRENGTH BAINITIC STEEL FOR OCTG APPLICATIONS

CROSS-REFERENCE TO RELATED APPLICATIONS

This application is a U.S. National Phase of PCT International Application No. PCT/EP2007/062492, filed Nov. 19, 2007 and published as WO 2009/065432 on May 28, 2009, the disclosure of which is incorporated by reference in its entirety and should be considered a part of this specification.

FIELD OF THE INVENTION

The present invention relates to a high strength bainitic steel, to a process for producing seamless pipes for OCTG applications and to the use of this steel for OCTG applications.

BACKGROUND OF THE INVENTION

Quenched and tempered martensitic steels are currently broadly used to produce high strength seamless pipes for OCTG applications.

One interesting alternative to get improved mechanical properties is the use of carbide-free bainitic steels in the as rolled or as rolled and tempering conditions. The chemical composition of these steels must be carefully designed to suppress the ferrite and pearlite reactions during the slow air cooling from the austenitic range after hot rolling.

The loss of toughness and ductility commonly observed in bainitic steels is usually related to the presence of coarse cementite particles between the bainitic ferrite sheaves. In order to avoid this problem, it was proposed to inhibit the cementite formation by the addition of more than 1 wt % of Silicon or Aluminum. These elements can not be dissolved in cementite, and hence suppress its precipitation.

From the document WO96/22396 there is known a carbide-free high Si/Al bainitic steel, but it is used for different applications than for OCTG applications. In particular WO 96/22396 discloses a method of producing a bainitic steel product, whose microstructure is essentially carbide-free, comprising the steps of: hot rolling the steel product and either cooling the steel from its rolling temperature to ambient temperature continuously and naturally in air or by continuously accelerated cooling. The cooling rates used are between 225 and 2° C./s, therefore comprising very high cooling rates.

The material is produced as rolled or after accelerated cooling, and the product is always intended for different applications than for OCTG applications.

It is a fact that bainitic steels in the as rolled condition or after accelerated cooling can not be directly used for high strength OCTG applications. Due to the low yield to tensile strength ratio, the required tensile and impact properties cannot be achieved, in particular for some OCTG applications.

The need is therefore felt to provide a steel composition and a process for producing seamless steel tubes having high strength and toughness, suitable for OCTG applications.

SUMMARY OF THE INVENTION

The main object of the present invention is to provide an improved process for producing seamless free-carbide bainitic steel tubes, having high strength and toughness, suitable for OCTG applications.

Another object of this invention is to provide a steel composition for producing high strength seamless tubes for OCTG applications, with high Yield Strength (YS) and good toughness.

The present invention, therefore, proposes to achieve the purposes described above providing a process for the production of high strength bainitic steel seamless pipes comprising the following steps:

a) providing a steel having a composition comprising 0.2-0.4% by weight of C 0.05-1.5% by weight of Mn, 1.0-2.0% by weight of Si and 0-0.5% by weight of Al or, alternatively, 1.0-2.0% by weight of Al and 0-0.5% by weight of Si; 0.5-2.0% by weight of Cr; 0.2-0.5% by weight of Mo; 0.5-3.7% by weight of Ni, the remainder being iron and inevitable impurities;

b) hot rolling said steel at a predetermined temperature such as to obtain a seamless steel pipe;

c) continuously cooling the steel from the rolling temperature naturally in air or by a controlled cooling with an average cooling rate comprised between 0.10 and 1.0° C. per second in order to obtain mainly bainitic structures.

The product directly obtained by said process is a seamless steel pipe for OCTG applications that, according to claim 10, has a mainly cementite-free bainitic microstructure and displays a yield strength of at least 140 ksi and a Charpy V-notch impact energy at room temperature of at least 50 J (full size samples).

According another aspect of the invention, there are provided:

a high strength bainitic steel having, according to claim 10, the following composition:

0.2-0.4% by weight of C; 0.05-1.5% by weight of Mn, 1.0-2.0% by weight of Si and 0-0.5% by weight of Al or, alternatively, 1.0-2.0% by weight of Al and 0-0.5% by weight of Si; 0.5-2.0% by weight of Cr; 0.2-0.5% by weight of Mo; 0.5-3.7% by weight of Ni, 0-0.005% by weight of S, 0-0.015% by weight of P, 0-0.005% by weight of O; 0-0.003% by weight of Ca; 0-0.01% by weight of N; 0-0.15% by weight of Cu; balanced iron and incidental impurities;

and the use of said steel for the production of articles intended for OCTG applications.

The core of the invention is to use a mainly cementite-free bainitic structure in seamless tubes for high strength OCTG applications.

Advantageously a low temperature tempering treatment in the steel of the invention is also a non-conventional treatment because it is not used to improve toughness, since Charpy results are only marginally improved by this treatment, instead it is aimed at increasing yield strength through precipitation of small transition carbides and dislocation pinning by interstitials.

The advantages ensuing to the steel of the invention are the improvement in strength-toughness over tempered martensitic steels, and the simplified thermal treatment, because only a low temperature tempering treatment is needed, without previous quenching.

In comparison to the quenched and tempered martensitic steels, carbide-free bainitic steels in the condition as rolled and with low temperature tempering have, therefore, the following two major advantages:

a. quenching is not necessary and by avoiding the quenching treatment the microstructure results far more homogeneous, which allows thick walled tubes to be produced;

b. for the same steel composition, in comparison to conventional tempered martensitic structures, a better combination of strength and toughness can be achieved, in particular by tempering as rolled carbide-free bainitic structures.

BRIEF DESCRIPTION OF THE DRAWINGS

The foregoing and other objects will become more readily apparent by referring to the following detailed description and the appended drawings in which.

DETAILED DESCRIPTION OF PREFERRED EMBODIMENTS OF THE INVENTION

Figure 1:
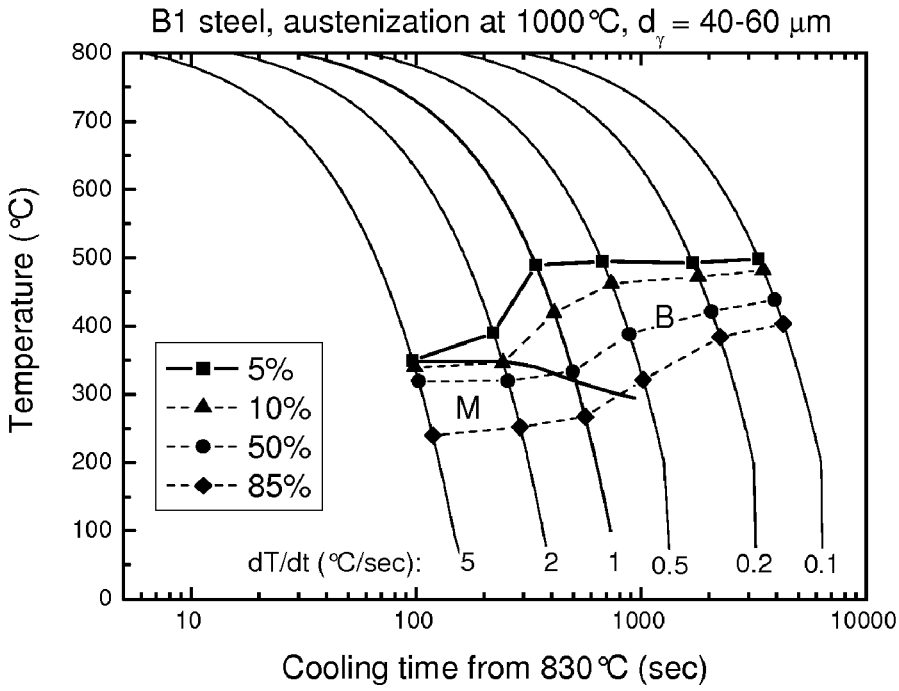
FIGS. 1, 2 and 3 show the CCT diagrams of B1, B2 and B3 alloys.

The steel of the invention has a composition in weight percent comprising:

C: 0.2-0.4; Mn: 0.05-1.5; Si: 1.0-2.0 and Al: 0-0.5 or, alternatively, Al: 1.0-2.0 and Si: 0-0.5; Cr: 0.5-2.0; Mo: 0.2-0.5; Ni: 0.5-3.70; S: 0-0.005; P: 0-0.015; Ca: 0-0.003; O: 0-0.005; Cu: 0-0.15; N: 0-0.01; balanced iron save for incidental impurities.

A first preferred composition of the steel comprises in weight percent:

C: 0.23-0.30; Mn: 0.05-1.0; Si: 1.2-1.65 and Al: 0-0.5 or, alternatively, Al: 1.2-1.65 and Si: 0-0.5; Cr: 0.7-1.8; Mo: 0.2-0.3; Ni: 0.5-3.6; S: 0-0.005; P: 0-0.015; Ca: 0-0.003; O: 0-0.002; Cu: 0-0.1; N: 0-0.01; balanced iron save for incidental impurities.

A further advantageous preferred composition of the steel comprises in weight percent:

C: 0.23-0.30; Mn: 0.05-0.7; Si: 1.2-1.6; Al: 0.01-0.04; Cr: 0.7-1.4; Mo: 0.2-0.3; Ni: 2.0-3.6; S: 0-0.003; P: 0-0.015; Ca: 0-0.002; O: 0-0.0015; N: 0-0.0080; Cu: 0-0.1; balanced iron save for incidental impurities.

The microstructure of the steel is essentially a fine cementite-free bainite with minor fractions of retained austenite and martensite. It is obtained after hot rolling and continuously cooling the steel from its rolling temperature naturally in air or by a controlled cooling.

Advantageously, the average cooling rate after hot rolling has to be in the range between 0.10 and 1.0° C./sec, preferably between 0.2 and 0.5° C./sec, in order to obtain mainly bainitic structures for the range of steel compositions tested. This is the case of tubes naturally cooled in air with wall thickness between 8 mm and 16-18 mm. For thicker or thinner tubes a controlled cooling with said average cooling rate may be needed to achieve the desired structure after hot rolling.

In spite of the high hardness, the as rolled bainitic structures have a low yield to tensile strength ratio, thereafter in this condition it is not possible to reach very high values of yield strength and at the same time the high impact properties needed for some OCTG applications, for example deep well applications.

Advantageously, in order to meet these requirements a tempering treatment at low temperatures (200-350° C.) has to be performed. During this treatment the yield strength strongly increases due to transition carbide precipitation and dislocation pinning by interstitials; and the impact properties are not impaired. As a consequence, a good combination of strength and toughness (suitable for high strength OCTG applications) can be achieved. The duration of this tempering treatment is about 30-60 minutes.

Regarding steel chemistry, in order to minimize coarse cementite precipitation, detrimental to toughness, during continuous cooling from the hot rolling temperature and during tempering, high Si or Al contents are used.

Advantageously, 1-2 weight percent of Si or Al has to be used. Both elements have similar effects on carbide precipitation during the bainitic reaction, because of their low solubility in cementite. If high Si is used, the Al content of the steel will be lower than 0.5 weight percent. Conversely, if high Al is used, the Si content of the steel will be below 0.5 weight percent.

The intermediate carbon contents, preferably 0.23-0.30 wt %, have the function of depressing the bainitic start temperature and getting microstructural refinement. Moreover, in order to achieve high strength in the as rolled condition, the transformation temperature is deplected by Mn, Ni, Cr and/or Mo alloying additions.

In particular, in order to avoid ferrite and perlite formation during natural air cooling Ni+2Mn has to be between 2 and 3.9, where Ni and Mn are concentrations in weight percent. Fulfilling this condition, Ni can be partially replaced by Mn in the steel composition.

However, in a preferred embodiment of the composition, Ni-content is present at high concentrations, preferably 2.0-3.6 wt %, for improving toughness while Mn is kept as low as possible, preferably 0.05-0.7 wt %, in order to avoid the formation of large blocks of retained austenite.

Mo is added at the herein specified levels, preferably 0.2-0.3 wt %, to avoid P segregation to interphases at low temperature.

Cr is added at the herein specified levels, preferably 0.7-1.4 wt %, to avoid, together with Mo and Ni, the ferrite and perlite formation during air cooling and to improve microstructural refinement by lowering the bainitic start temperature.

O is an impurity present mostly in the form of oxides. As the oxygen content increases, impact properties are impaired. Accordingly, a lower oxygen content is preferred. The upper limit of the oxygen content is 0.0050 wt %; preferably below 0.0015 wt %.

Cu is not needed, but depending on the manufacturing process may be unavoidable. Thereafter, a maximum content of 0.15 wt % is specified.

The contents of unavoidable impurities such as S, P, Ca, N, and the like are preferably low. However, the features of the present invention are not impaired as long as their contents are as follows: S not greater than 0.005 wt %; P not greater than 0.015 wt %, Ca not greater than 0.003 wt % and N not greater than 0.01 wt %; preferably S not greater than 0.003 wt %; P not greater than 0.015 wt %, Ca not greater than 0.002 and N not greater than 0.008 wt %.

EXAMPLES

The following examples are useful for better defining the invention and to point out the influence of the chemical composition and of the process steps on the behavior of the steel. In particular, the feasibility of producing high strength bainitic steels that fulfill the tensile and impact requirements of deep well OCTG products is investigated.

Performed Tasks

The following tasks were performed:

1. Three alloys (B1, B2 and B3 steels) were designed. The materials were laboratory cast and hot rolled in a pilot mill.
2. The as rolled microstructures were studied under optical and scanning electron microscopes. X-ray diffractometry was used to quantify the amount of retained austenite.
3. Standard tensile and Charpy impact (at −20° C., 0° C. and room temperature) tests were carried out on as rolled samples. Hardness measurements were also performed.
4. The transformation behavior of the alloys was studied in a thermomechanical simulator. CCT diagrams were measured for all steels.
5. To determine the effect of different thermal cycles on mechanical properties, normalization and tempering treatments were performed on as rolled plates. Hardness, tensile and impact measurements were conducted on the heat treated samples.

Alloy Design

The alloy design was aimed to produce a microstructure mainly composed of bainitic ferrite and films of retained austenite during air cooling from the austenitic range. From calculations performed with a computer program, it was estimated that, for tube thicknesses between 24 mm and 6 mm, the average cooling rate at the exit of the hot rolling mill (rolling temperature: 1100-950° C.) is in the range between 0.1° C./sec and 0.5° C./sec. Several chemistries were designed to get the desired microstructure during cooling at the above mentioned rates. The concentration of each element was selected with the aid of a metallurgical model for the prediction of TTT diagrams (H. K. D. H. Bhadeshia, "A thermodynamic analysis of isothermal transformation diagrams", Metal Science, 16 (1982), pp. 159-165). The resulting chemistries (B1, B2 and B3) are shown in Table 1.

TABLE 1

Chemistries specified (in wt %) for bainitic steels B1, B2 and B3.

| | B1 | B2 | B3 |
|---|---|---|---|
| C | 0.25 | 0.30 | 0.35 |
| Mn | 0.10 | 0.10 | 0.60 |
| Si | 1.40 | 1.40 | 0.30 |
| Cr | 1.00 | 1.00 | 1.70 |
| Al | 0.03 | 0.03 | 1.20 |
| Mo | 0.25 | 0.25 | 0.25 |
| Ni | 3.6 | 3.6 | 3.6 |
| S | <0.005 | <0.005 | <0.005 |
| P | <0.01 | <0.01 | <0.01 |

The only difference between B1 and B2 steels was the carbon content, which was changed in order to study its effect on microstructure and mechanical properties. In B3 steel several changes were performed in comparison with the previous alloys: C was increased to improve microstructural refinement and Si was replaced by Al as the element used to inhibit cementite precipitation. As Al is a ferrite stabilizer, which strongly accelerates the ferrite reaction, Mn and Cr contents were increased to avoid the formation of polygonal ferrite during slow air cooling.

The meaning of appearance of the main alloying elements in B1, B2 and B3 steels can be summarized as follows:

C: Intermediate carbon contents were used to depress the bainitic start temperature, with the subsequent improvement in microstructural refinement.

Si/Al: High silicon or aluminum contents were used to inhibit cementite precipitation during austenite decomposition.

Cr and Mo: These elements in combination with Ni were used to increase hardenability. Basically they were intended to avoid the ferrite and perlite formation during air cooling. Other aim was the bainitic start temperature depression to improve microstructural refinement.

Ni: As Cr and Mo, this element was used to increase hardenability. Additionally, it improves toughness when present at high concentrations.

Mn: This element content was kept low as possible to avoid the formation of large blocks of retained austenite.

From calculations performed with the metallurgical model, it was estimated that B1, B2 and B3 steels would present a mainly bainitic microstructure after cooling at 0.1-0.5° C./sec. At the lower end of this range some ferrite was expected to be formed. But even cooling at 0.1° C./sec, the maximum ferrite volume fraction was estimated to be lower than 5% due to the sluggish reaction kinetics associated to the high alloying additions. Conversely, for cooling rates higher than 0.5° C./sec, some martensite was expected to appear. Its maximum amount was difficult to estimate due to uncertainties in the calculation of bainite reaction kinetics.

Thereafter, it was expected a final microstructure mainly composed of bainite for cooling rates between 0.1° C./sec and 0.5° C./sec. For these alloys, the calculated bainitic start temperatures (BS) were below 500° C.: 471° C. for B1, 446° C. for B2 and 423° C. for B3. A low transformation temperature was desired to produce an ultrafine structure capable of achieving high strength without loosing toughness.

EXPERIMENTAL

The bainitic steels B1, B2 and B3 were laboratory melted in a 20 Kg vacuum induction furnace. The obtained steel chemistries are shown in Table 2.

TABLE 2

Chemistries (in wt %) obtained in laboratory for B1, B2 and B3.

| | B1 | B2 | B3 |
|---|---|---|---|
| C | 0.24 | 0.30 | 0.32 |
| Mn | 0.09 | 0.10 | 0.61 |
| Si | 1.27 | 1.42 | 0.30 |
| Cr | 1.00 | 1.03 | 1.74 |
| Mo | 0.23 | 0.22 | 0.25 |
| Ni | 3.64 | 3.48 | 3.58 |
| S | 0.001 | 0.002 | 0.001 |
| P | 0.005 | 0.01 | 0.006 |
| Cu | 0.1 | 0.1 | 0.1 |
| Al | 0.014 | 0.040 | 1.25 |
| N | 0.0063 | 0.0023 | 0.0025 |
| O | 0.0014 | 0.0011 | 0.0007 |

The resulting slabs of 140 mm thickness were hot rolled in a pilot mill to a final thickness of 16 mm. During hot rolling, the reheating and finishing temperatures were 1200-1250° C. and 1000-950° C., respectively. After hot rolling, the plates were air cooled to room temperature.

The as rolled microstructures were analyzed using optical and scanning electron microscopes. Vickers hardness measurements were also performed, and the amount of retained austenite was determined using X-ray diffractometry.

Standard tensile and Charpy tests were conducted on as rolled samples. Tensile properties were averaged over results obtained for two samples. Impact properties at room temperature, 0° C. and −20° C. correspond to average values over 3 full-scale Charpy tests for each temperature. In all the cases the samples were taken in the transversal direction.

The continuous cooling transformation diagrams (CCT) of B1, B2 and B3 steels were determined from dilatometric tests performed at a thermomechanical simulator. Cooling rates in the range between 0.1° C./sec and 5° C./sec were considered.

The obtained microstructures were characterized by optical microscopy and hardness measurements.

Several heat treatments were performed on B2 as rolled plates of 16 mm thickness:

Normalizing: reheating at 840° C. during 15 minutes and then air cooling;

Tempering at 200-500° C. during 30-60 minutes and air cooling.

From the heat-treated plates tensile and full size Charpy specimens were machined and tested using a procedure similar to that already described for the as rolled materials.

Experimental Results a) CCT Diagrams

From dilatometric measurements, the CCT diagrams of B1, B2 and B3 steels were derived. In all cases the samples were reheated at 5° C./sec up to 1000° C. without holding time, and then cooled to room temperature at a constant rate (0.1-10° C./sec). For this austenization condition, the austenitic grain size prior to transformation was 40-60 μm for all the materials. The obtained diagrams are presented in FIGS. 1-3, where the temperatures to 5%, 10%, 50% and 85% of transformation are plotted as a function of the cooling time.

Figure 4:
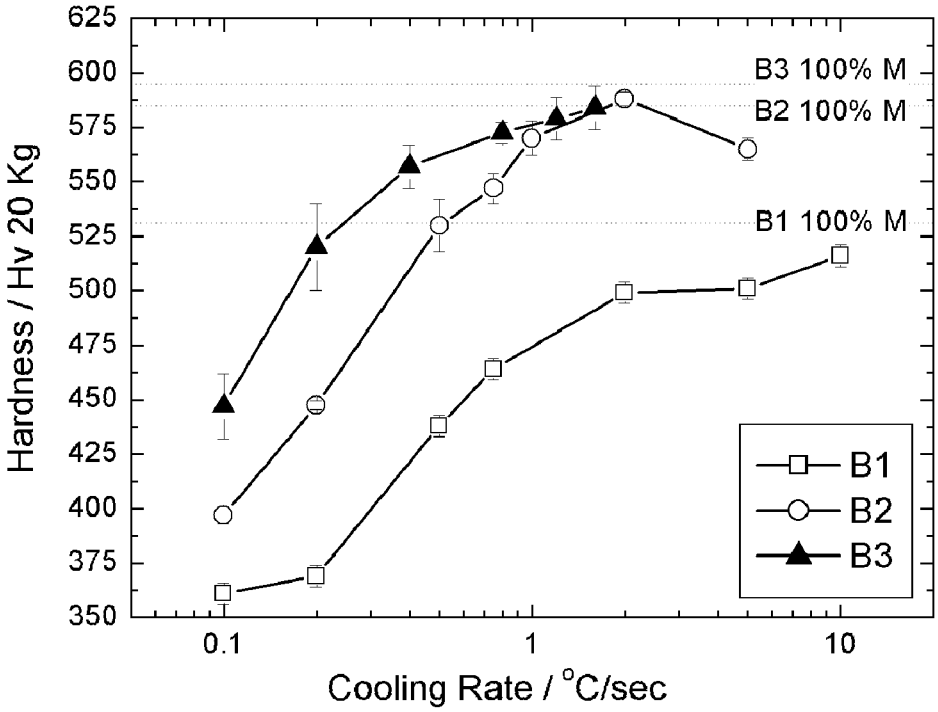
FIG. 4 shows measured hardness values of B1, B2 and B3 steels as a function of the cooling rate.

In FIG. 4 hardness values are shown as a function of the cooling rate for all steels. In the same plot, the calculated hardness values corresponding to 100% martensitic microstructures are presented as reference. These values were derived using the set of empirical expressions developed by Maynier et al (Ph. Maynier, B. Jungmann and J. Dollet, "Creusot-Loire system for the prediction of the mechanical properties of low alloy steels products", Hardenability concepts with applications to steels, Ed. D. V. Doane and J. S. Kirkaldy, The Metallurgical Society of AIME (1978), pp. 518).

From dilatometric data, hardness measurements, optical and scanning electron microscopy, the general phase transformation behavior of B1, B2 and B3 steels was assessed:

B1 steel: For cooling rates higher than 2° C./sec an important part of the transformation took place at temperatures below the calculated martensitic start temperature ($MS_{Andrews}$=349° C.; see K. W. Andrews, "Empirical formulae for the calculation of some transformation temperatures", Journal of the Iron and Steel Institute, July 1965, pp. 721).

At 2° C./sec the martensitic volume fraction was estimated from dilatometric measurements as 70%, increasing to 90% at 10° C./sec. These results were supported by optical and scanning electron microscopy. Additionally, the hardness values of the samples cooled at 2, 5 and 10° C./sec were slightly below that corresponding to a fully martensitic structure (FIG. 4).

For cooling rates lower than 2° C./sec the transformation start temperature (temperature to 5% of transformation) gradually increased until it reached what it seemed to be a plateau at 500° C. (FIG. 1).

For cooling rates between 1.5° C./sec and 0.5° C./sec the final microstructure was mainly bainitic, with retained austenite replacing the $M_3C$ carbides.

At cooling rates lower than 0.2° C./sec, some ferritic regions were observed (volume fraction lower than 5%).

B2 steel: It can be seen in FIG. 2 that at cooling rates equal or higher than 1° C./sec most of the transformation proceeded below the MS ($MS_{Andrews}$=315° C.).

Optical and scanning electron microscopy confirmed together with hardness measurements that for these cooling conditions the final microstructure was mainly martensitic.

For cooling rates lower than 1° C./sec, the amount of austenite transformed at temperatures above the MS increased continuously. Below 0.5° C./sec great part of the transformation took place above the MS and below the calculated bainitic start temperature (BS=446° C.). For this range of cooling rates the observed microstructure was a fine mixture of bainite and retained austenite.

B3 steel: In this case the microstructure was mostly martensitic at cooling rates higher than 0.8° C./sec. The CCT diagram (FIG. 3) shows that nearly 90% of the transformation took place below the martensitic start temperature ($MS_{Andrews}$=315° C.) for this range of cooling rates. For cooling rates lower than 0.8° C./sec the amount of bainite increased gradually until reaching approximately 80% at 0.1° C./sec.

Figure 2:
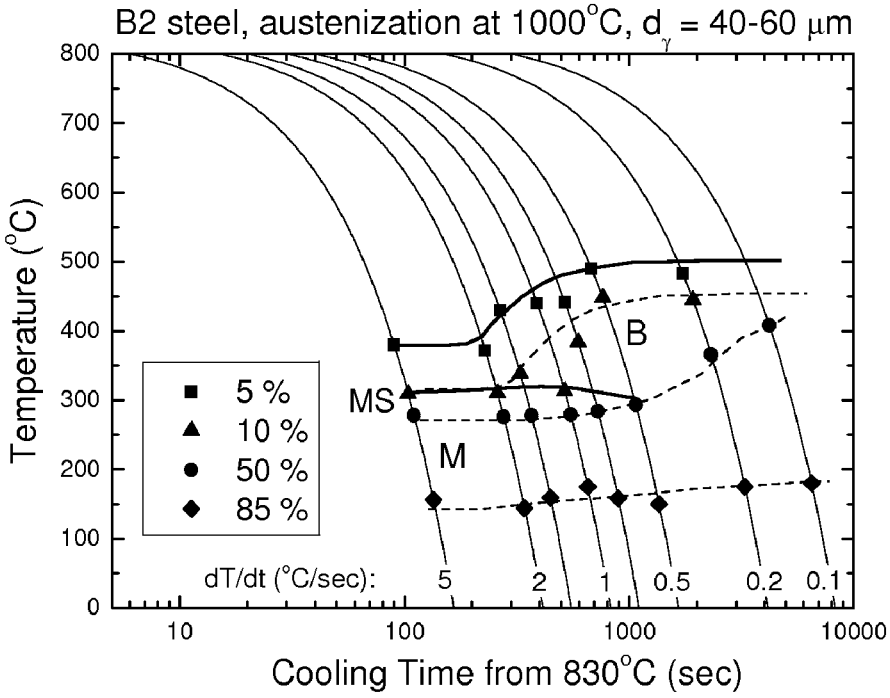
Figure 3:
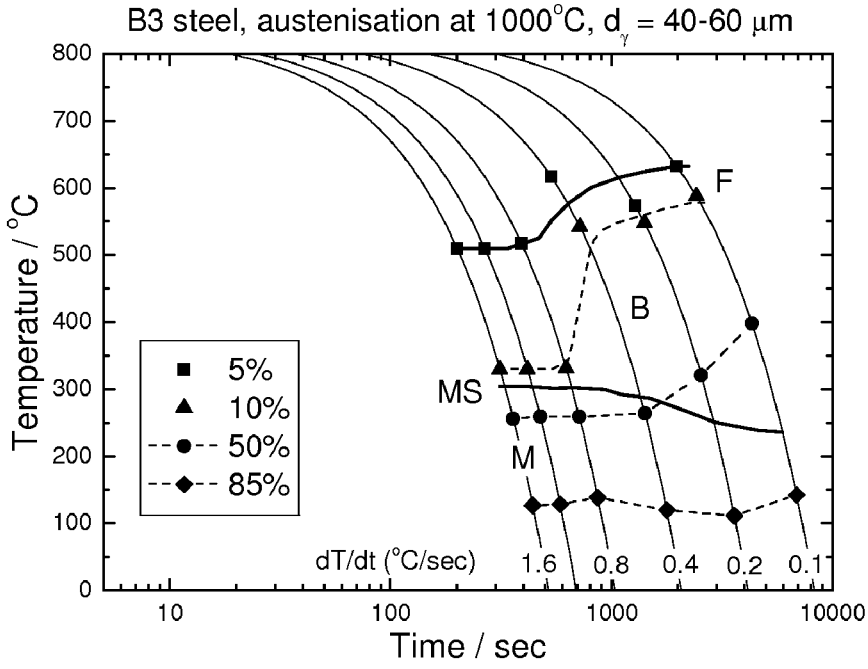

When comparing the results obtained for B1 and B2 steels in FIGS. 1-2, it appears that the carbon increment in the second alloy did not produce an important change in the bainitic start temperature. However, there was a noticeable change in the transformation kinetics: the reaction proceeded more slowly in B2 steel, as can be seen in the shift to lower values of the temperatures to 50% and 85% of transformation.

Regarding B3 steel, in comparison to B1 and B2 the hardenability was strongly increased by the Cr and Mn addition. The critical cooling rate to obtain 90% martensite was reduced from 2° C./sec in previous alloys to 0.8° C./sec. Even at 0.1° C./sec about 20% of martensite appeared. On the other hand, the effect of Al as a ferrite stabilizer is evident in the transformation start temperatures: for B3 steel cooled at 0.2-0.1° C./sec the transformation begins at 600° C., whereas for B1 and B2 steels cooled at the same rates the reaction starts 100° C. below the above mentioned temperature.

b) As Rolled Microstructures

Figure 5:
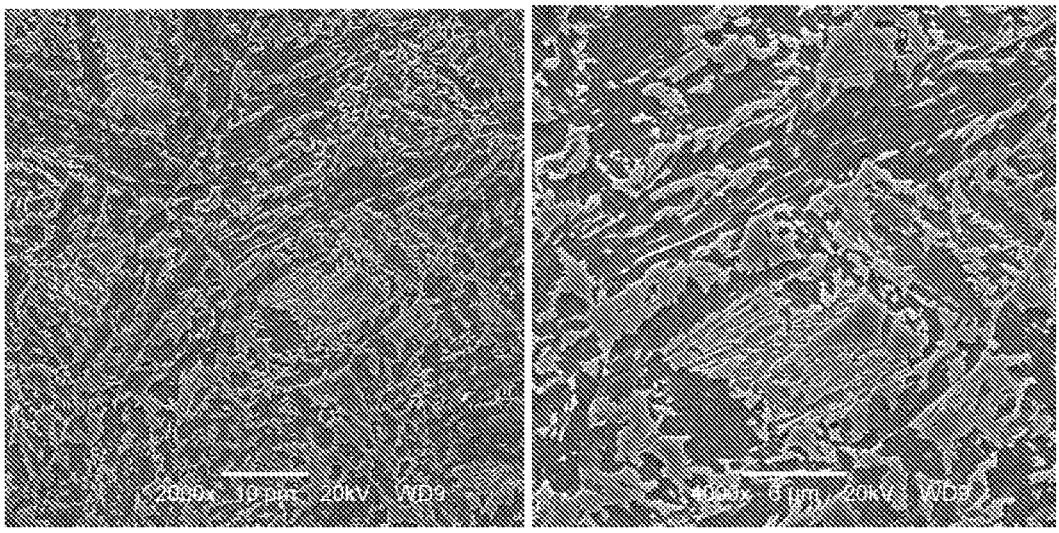
FIG. 5 shows the as rolled microstructure of B1 steel (scanning electron micrographs)

SEM micrographs of B1 steel in the as rolled condition are shown in FIG. 5. As expected, the microstructure presented a bainitic morphology with retained austenite between bainitic sheaves. The amount of retained austenite was estimated as 18% from X-ray diffractometry. No large carbides were observed, but the size of the blocky austenitic regions between bainitic sheaves was as high as 5 μm. The microhardness of this structure was 382±5 Hv (20 Kg). The austenitic grain size prior to transformation, estimated from optical and SEM micrographs, was in the 40-60 μm range.

Figure 6:
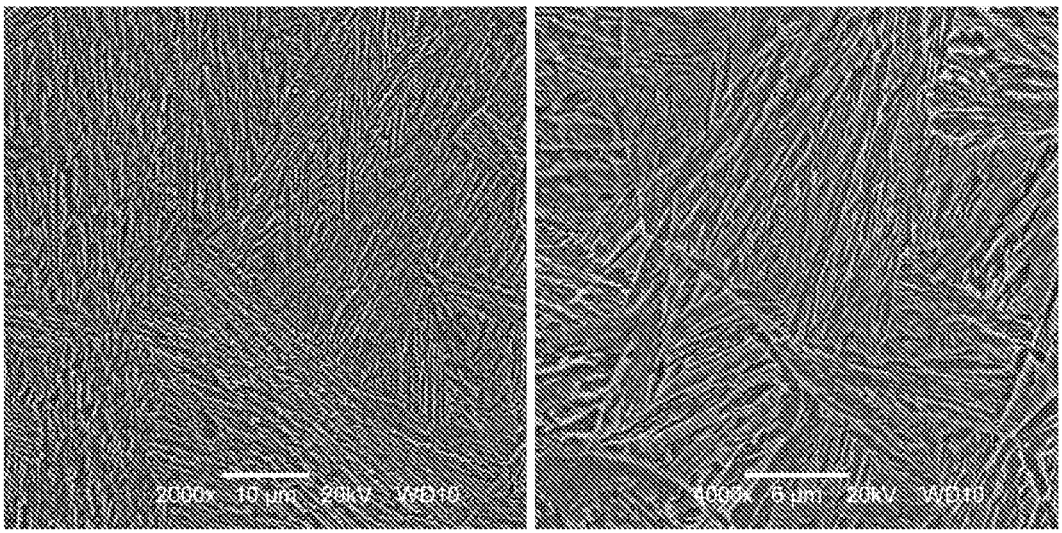
FIG. 6 shows the as rolled microstructure of B2 steel (scanning electron micrographs)

SEM micrographs of B2 steel as rolled are shown in FIG. 6. In these micrographs it is clear that the microstructure was mainly composed of fine bainite. There were also some small regions that may be identified as retained austenite and slightly auto-tempered martensite. Regarding the austenitic grain size prior to transformation, it was seen that the size dispersion was very large, ranging from 30 μm to 80 μm with an average value around 50-60 μm. The amount of retained austenite was estimated as 13% from X-ray diffraction. The retained austenite is present in the bainitic regions as interlath lamellas of thickness lower than 1 μm. Only few blocky austenitic regions were observed in the microstructure. The as rolled B2 hardness was 468±5 Hv (20 Kg), it was very similar to that obtained after heat treatment at dilatometer when the cooling rate was 0.2° C./sec. It can be concluded that 0.2° C./sec was the average cooling rate during phase transformation of the 16 mm plates cooled in air after hot rolling.

Figure 7:
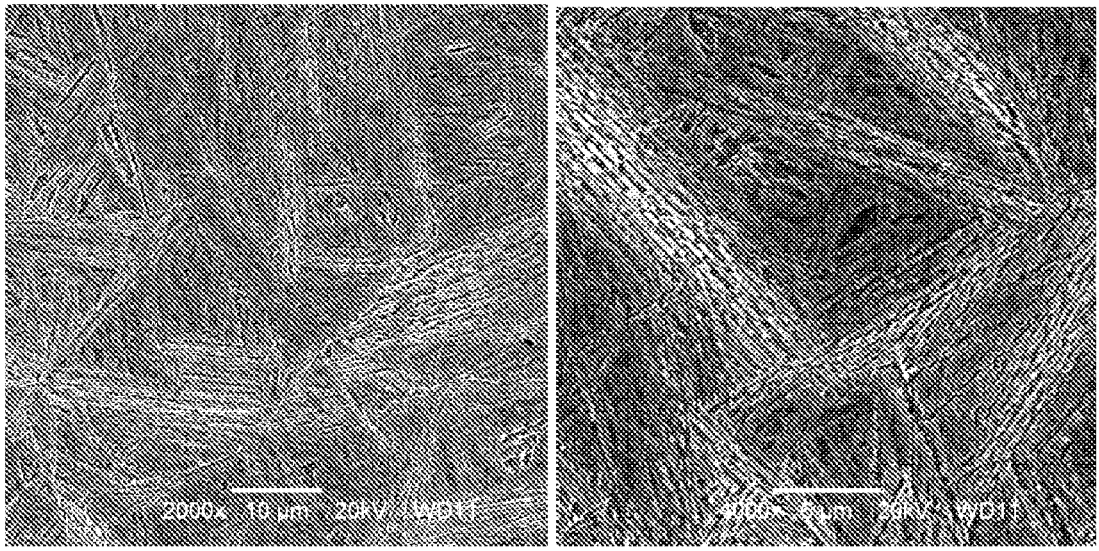
FIG. 7 shows the as rolled microstructure of B3 steel (scanning electron micrographs)

In FIG. 7 some B3 as rolled micrographs are presented. In this case, a fine bainitic structure can be observed together with some martensitic regions. The appearance of martensite could be anticipated from the dilatometric measurements, which showed that this phase appears even when cooling at the low rates (0.1-0.2° C./sec) corresponding to air cooling 16 mm thickness plates.

When comparing the as rolled microstructures of B1 and B2 steels, it can be seen that the bainitic structure in the higher carbon alloy (B2) was more refined in comparison to the low carbon steel (B1). In addition, the blocky austenitic regions that appeared in B1 alloy were almost not present in B2 steel. Due to their low thermal and mechanical stability, these blocky austenitic regions may transform to martensite upon impact loading, thereafter are considered detrimental to toughness. The main reason for the important microstructural differences between B1 and B2 was the change in carbon content.

Regarding B3 steel as rolled, its bainitic structure is finer in comparison to B1 and B2. However, some martensitic regions, which were not present in B1 and B2 steels, appeared in this case. The presence of martensite is not desirable in these materials because it is a brittle phase that impairs toughness. The higher hardenability of B3 steel can be ascribed to the increment in Mn and Cr contents. These additions were intended to compensate the Al acceleration effect on the ferrite reaction kinetics, but it caused the appearance of martensite.

c) Mechanical Properties of B1, B2 and B3 as Rolled

The tensile and impact properties measured for B1, B2 and B3 steels as rolled are shown in the following tables.

TABLE 3

B1, B2 and B3 as rolled tensile properties.

| Steel | YS (MPa) | YS (ksi) | UTS (MPa) | UTS (ksi) | YS/UTS |
|---|---|---|---|---|---|
| B1 as rolled | 816 | 118 | 1185 | 172 | 0.69 |
| B2 as rolled | 965 | 140 | 1447 | 210 | 0.67 |
| B3 as rolled | 1040 | 151 | 1645 | 239 | 0.63 |

The yield strengths were measured using the 0.2% offset method.

TABLE 4

Impact properties of as rolled B1, B2 and B3 steels.

| | Charpy (10 × 10 mm) | | |
|---|---|---|---|
| Steel | T (° C.) | CVN (J) | Ductile Area (%) |
| B1 as rolled | 24 | 24 | 25 |
| | 0 | 20 | <20 |
| | −20 | 17 | <20 |
| B2 as rolled | 24 | 69 | 100 |
| | 0 | 58 | 100 |
| | −20 | 49 | 48 |
| | −40 | 42 | 34 |
| B3 as rolled | 24 | 23 | 25 |
| | 0 | 21 | 23 |
| | −20 | 22 | 19 |

When comparing the two high Silicon alloys (B1 and B2), it can be seen that B2 steel presented better tensile and impact properties than B1. This improvement in mechanical properties can be ascribed to the microstructural refinement resulting from the higher carbon addition. In particular, it is interesting to notice that impact property results are in opposition with commonly accepted trends regarding toughness dependence on carbon content, and can be related to the Si presence that is preventing carbide precipitation. When the carbide precipitation is inhibited, an increase in carbon content impairs the ferrite reaction kinetic producing microstructural refinement, with the subsequent increase in strength and toughness. Another important effect is that for the higher carbon steel the appearance of blocky austenitic regions, detrimental to toughness, was reduced probably due to the depletion of the transformation to lower temperatures.

Regarding B3 steel, the observed high strength in combination with low toughness can be directly associated to the presence of martensite in the as rolled structure.

From Tables 3 and 4, it can be seen that advantageously the best combination of mechanical properties corresponded to B2 steel as rolled: 140 ksi of yield strength and 69 Joules of impact energy at room temperature with a ductile to brittle transition temperature of −20° C. The other two materials did not present 100% ductile fractures in Charpy tests at room temperature.

It is important to notice that from the experimental CCT diagram only minor microstructural differences can be expected when B2 steel is cooled at rates between 0.15° C./sec and 0.30° C./sec, which correspond to air cooling of tubes with wall thickness between 16 mm and 8 mm. Thereafter, nearly the same microstructural and mechanical properties can be obtained with one chemistry for a wide range of tube geometries.

For tubes thicker than 16 mm, and up to 24 mm, the cooling rate at the exit of the hot rolling mill is expected to be in the range between 0.15° C./sec and 0.10° C./sec.

In this case some ferrite may be formed. In order to avoid this, an advantageous controlled cooling with cooling rate between 0.2 and 0.5° C./sec can be performed after hot rolling or a chemical composition change.

In summary, B2 steel in the as rolled condition advantageously presented a good combination of tensile and impact properties. In order to further improve strength and toughness, chemical changes or heat treatments are needed.

d) Heat Treatments of B2 Steel

To study the affect of different microstructural parameters on B2 mechanical properties, several heat treatments were performed, including normalization and tempering at temperatures between 200° C. and 500° C. Some of the results obtained are presented in the following Tables 5 and 6.

TABLE 5

Tensile properties of B2 steel after different heat treatments.

| Steel B2 | YS (MPa) | YS (ksi) | UTS (MPa) | UTS (ksi) | YS/UTS |
|---|---|---|---|---|---|
| As rolled | 965 | 140 | 1447 | 210 | 0.67 |
| Normalized | 968 | 140 | 1545 | 224 | 0.63 |
| Tempered at 300° C. | 1232 | 179 | 1563 | 226 | 0.79 |
| Tempered at 500° C. | 1040 | 151 | 1409 | 205 | 0.74 |

The yield strengths were measured using the 0.2% offset method.

In Table 5, it can be seen that the tensile properties were not strongly changed by the normalizing treatment.

Figure 6A:
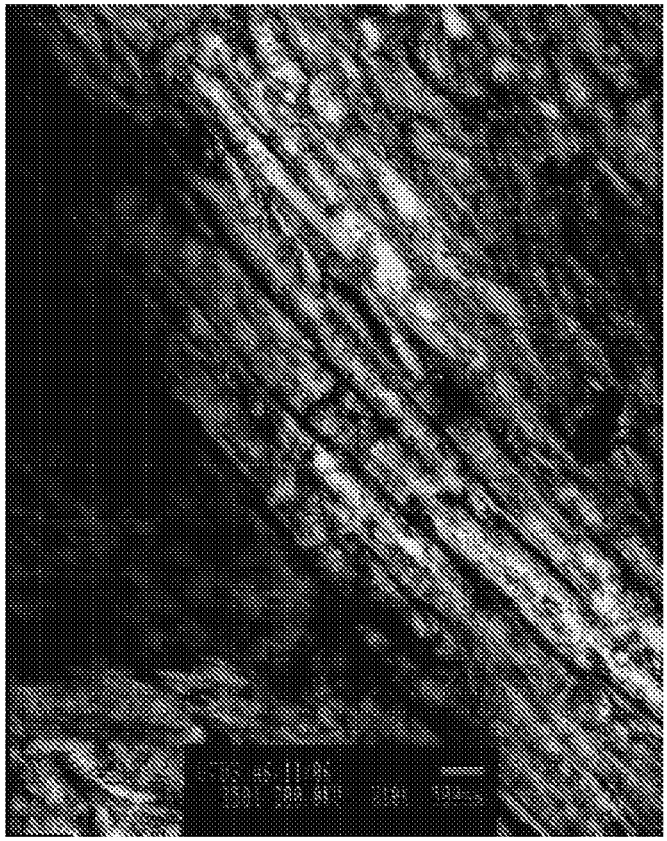
FIG. 6*a* show the microstructure of B2 as rolled and tempered at 300° C. (transmission electron image)

The results obtained after tempering were more interesting. There was a strong increase in yield strength after heat treatment at 300° C. The strength improvement can be ascribed to transition carbide precipitation and pinning of dislocations by interstitials. When the tempering temperature was increased to 500° C., the tensile strength decreased (in comparison to the previous treatment) probably due to the replacement of the fine transition carbides by coarse cementite particles. In order to be sure about the metallurgical mechanism that produced the important yield strength increase after tempering at 300° C., a TEM study has been carried out on selected B2 tempered and as rolled samples. A TEM micrograph of B2 steel tempered at 300° C., illustrated in FIG. 6*a*, showed that the thickness of the bainitic sheaves is 0.2-0.5 μm.

TABLE 6

Impact properties of B2 steel after different heat treatments.

| B2 Steel | Charpy (10 × 10 mm) T (° C.) | CVN (J) | Ductile Area (%) |
|---|---|---|---|
| As rolled | 24 | 69 | 100 |
| | 0 | 58 | 100 |
| | −20 | 49 | 48 |
| | −40 | 42 | 34 |
| Normalized | 24 | 56 | 100 |
| | 0 | 48 | 100 |
| | −20 | 44 | 41 |
| Tempered at 300° C. | 24 | 75 | 100 |
| | 0 | 68 | 100 |
| | −20 | 52 | 49 |
| Tempered at 500° C. | 24 | 18 | 23 |
| | 0 | 15 | 11 |
| | −20 | 15 | 8 |

Regarding impact properties, when comparing the results for the as rolled and normalized materials it is clear that the refinement of the austenitic grain size (from 50-60 μm in the as rolled condition to <30 μm after normalizing) did not produce a toughness improvement. This lack of sensibility to the grain size shows that there is another microstructural parameter (for example the size/thickness of the austenitic regions between the bainitic ferrite laths) that is the toughness controlling factor. The results obtained for the material tempered at 300° C. pointed in the same direction. In this case the toughness was improved without refining the austenitic grains or reducing the bainitic packet size. Considering that the maximum volume fraction of bainite corresponding to the isothermal transformation at 300° C. was not probably achieved during continuous cooling, the retained austenite may continue the reaction during tempering, reducing the size of the interlath austenitic regions. This possibility was supported by:

1) a small reduction of retained austenite, from 13% in the as rolled material to 10% in the sample tempered at 300° C. observed using X-Ray diffractometry; and 2) the progress of the austenite decomposition during tempering at 300° C. observed in a dilatometric test.

Figure 8:
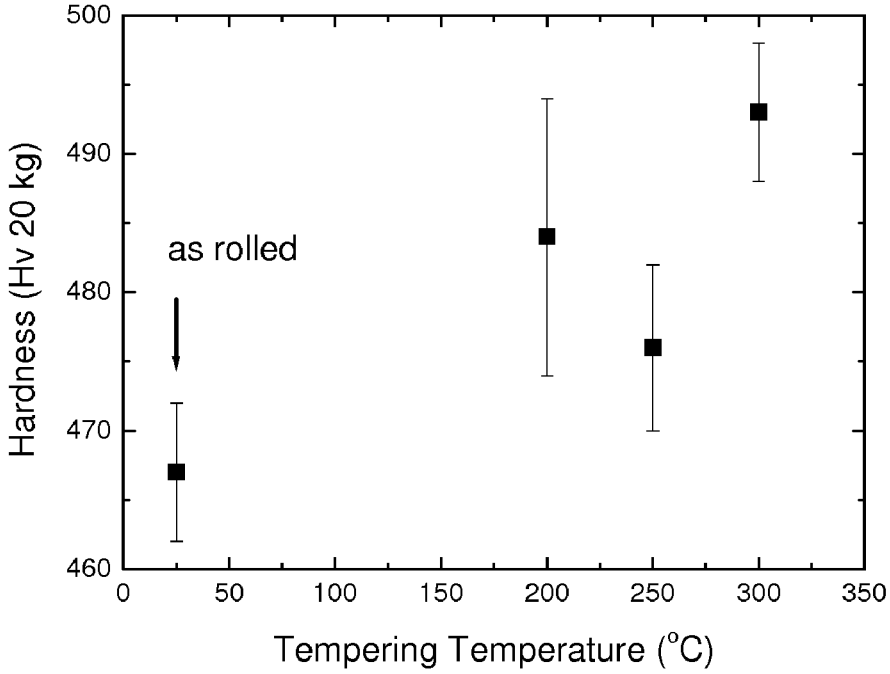
FIG. 8 shows hardness of B2 steel after different tempering treatments at low temperatures (1 hour of holding)

Regarding the possibility of a toughness improvement related to the tempering of small martensitic regions, this is not in agreement with the hardness increase observed after tempering at 200-300° C. the as rolled material (see FIG. 8).

About the tempering treatment at 500° C., it is clear that extensive carbide precipitation and coarsening took place, slightly improving yield strength but strongly deteriorating toughness in comparison to the as rolled material.

The results obtained after different heat treatments of B2 steel showed that one way to improve yield strength and toughness is by tempering the material at low temperatures comprised between 200 and 350° C., preferably about 300° C. In this case, the transition carbide precipitation improves strength, and the refinement in the bainitic microstructure and the reduction in the interlath austenitic regions improve toughness.

e) Comparison with Known Quenched and Tempered (Q+T) Martensitic Steels

Figure 9:
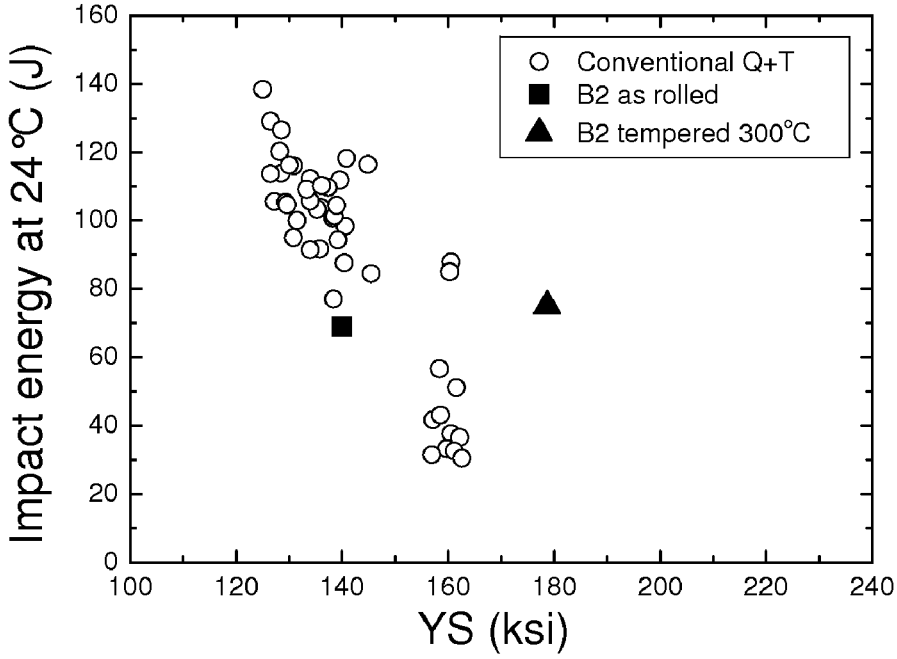
FIGS. 9 and 10 respectively show Charpy impact energy at room temperature (full size samples) as a function of the yield strength and of the ultimate tensile strength of B2 steel as rolled and B2 steel as rolled and tempered at 300° C.
Figure 10:
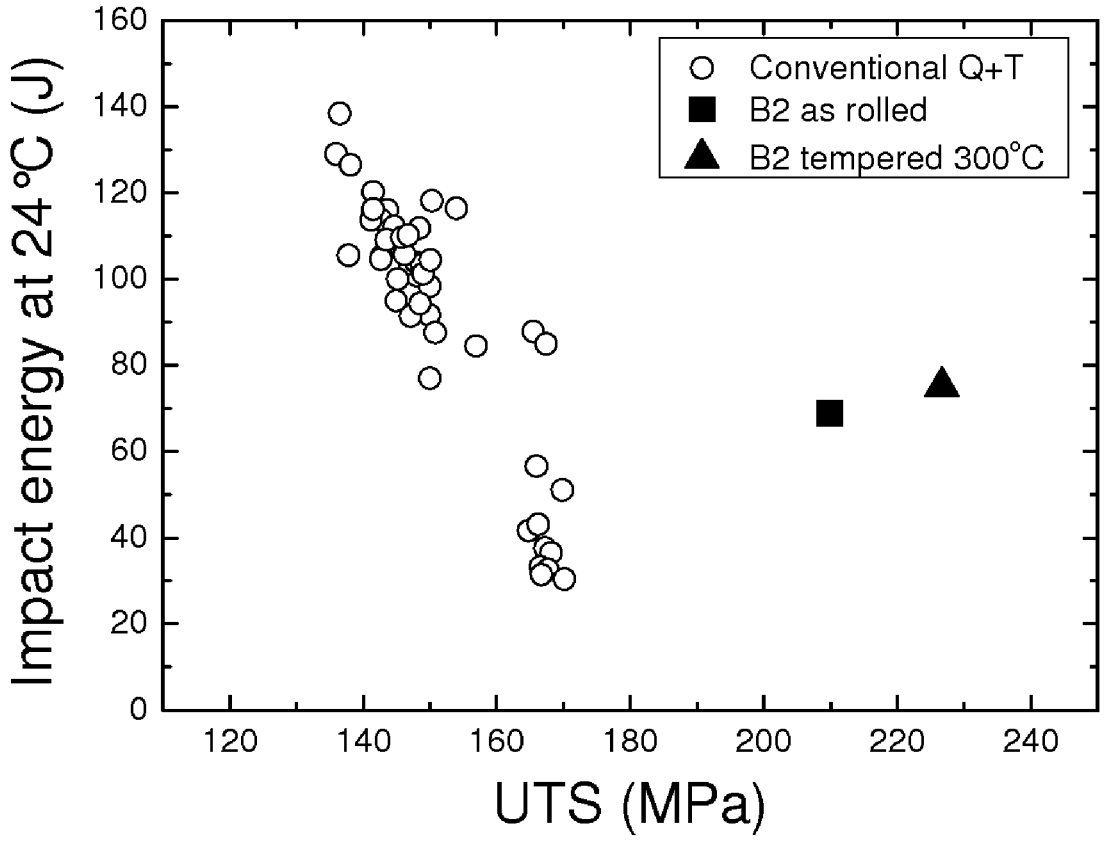

In FIGS. 9 and 10 the Charpy impact energies of B2 steel as rolled and as rolled and tempered at 300° C. are compared to values obtained with conventional tempered martensitic structures.

The most promising combination of mechanical properties was obtained with B2 steel tempered at 300° C. Due to the high yield strength and good toughness, this material is positioned above the toughness-strength curve of quenched and tempered steels.

g) Conclusions

From the results obtained, it can be concluded that the bainitic steel of the invention in the as rolled condition has good combination of strength and toughness when the microstructure is composed of a fine mixture of bainitic ferrite and retained austenite (B2 steel). If the structure is coarse with blocks of retained austenite between bainitic sheaves (B1 steel) or when large martensitic regions are present (B3 steel) the impact properties are impaired.

With its fine bainitic structure without large blocky austenitic or martensitic regions B2 steel as rolled is therefore suitable for OCTG applications.

The most promising combination of mechanical properties was obtained with B2 steel as rolled and tempered at 300° C. Due to the high yield strength and good toughness, this material is positioned above the toughness-strength curve of the quenched and tempered martensitic steels.

Advantageously the bainitic steel tubes or pipes, obtained by means of the process of the invention, have homogeneous mechanical properties due to the avoidance of the quenching treatment. In particular B2 steel, hot rolled and tempered, presents the same mechanical properties for a wide range of tube wall thickness, between 18 mm and 8 mm.

For tubes up to 18 mm thickness, the alloying additions in B2 steel can be reduced if accelerated cooling after hot rolling is available.

For thicker tubes (up to 35 mm), the decrease in the cooling rate at the exit of the hot rolling mill has to be compensated by a controlled cooling at 0.10-1.0° C./sec, preferably 0.2-0.5° C., or by alloying additions.

Modifications of B2 steel chemistry may be performed without changing the principles of the invention, that is to produce an ultra-fine bainitic structure in the as rolled condition with minor fractions of martensite and blocky austenitic regions, and, in a advantageous embodiment of the invention, to perform a tempering at low temperature to increase the yield to tensile strength ratio to make the material suitable for high strength OCTG applications. For example Ni can be substituted by Mn as an austenitizing element, Or and C contents may be changed depending on tube thickness, or microalloying elements (Ti and Nb) may be added to control austenitic grain size during hot rolling.

It is to be understood that the foregoing description and specific embodiments are merely illustrative of the best mode of the invention and the principles thereof, and that various modifications and additions may be made by those skilled in the art, without departing from the spirit and scope of this invention, which is therefore understood to be limited only by the scope of the appended claims.

The invention claimed is:

1. Process A method for the production of high strength bainitic steel seamless pipes comprising the following steps:

a) providing a steel having a composition comprising 0.2-0.4% by weight of C 0.05-1.5% by weight of Mn; 1.0-2.0% by weight of Si and 0-0.5% by weight of Al or, alternatively, 1.0-2.0% by weight of Al and 0-0.5% by weight of Si; 0.5-2.0% by weight of Cr; 0.2-0.5% by weight of Mo; 2.0-3.7% by weight of Ni; the remainder being iron and inevitable impurities;

b) hot rolling said steel at a temperature to obtain a seamless steel pipe;

c) continuously cooling the steel from the rolling temperature naturally in air or by a controlled cooling with an average cooling rate of between 0.10 and 1.0° C. per second in order to obtain mainly cementite-free bainitic structures;

wherein the steel has a transversal toughness that satisfies one or more of the following: a transversal toughness at 24° C. of at least 69-75 J, a transversal toughness at 0° C. of at least 58-68 J, and a transversal toughness at −20° C. of at least 49-52 J.

2. The method according to claim 1, wherein said average cooling rate is between 0.2 and 0.5° C. per second.

3. A method for the production of high strength bainitic steel seamless pipes comprising the following steps:

a) providing a steel having a composition comprising 0.2-0.4% by weight of C 0.05-1.5% by weight of Mn; 1.0-2.0% by weight of Si and 0-0.5% by weight of Al or, alternatively, 1.0-2.0% by weight of Al and 0-0.5% by weight of Si; 0.5-2.0% by weight of Cr; 0.2-0.5% by weight of Mo; 0.5-3.7% by weight of Ni; the remainder being iron and inevitable impurities;

b) hot rolling said steel at a temperature to obtain a seamless steel pipe;

c) continuously cooling the steel from the rolling temperature naturally in air or by a controlled cooling to obtain mainly bainitic structures;

d) tempering the steel at low temperatures in the range of 200-350° C.

4. The method according to claim 3, wherein tempering is carried out at a temperature of about 300° C.

5. The method according to claim 4, wherein the duration of the tempering step is about 30-60 minutes.

6. The method according to claim 1, wherein the rolling temperature is between 1250° C. and 950° C.

7. The method according to claim 1, wherein the steel has a composition comprising 0.23-0.30% by weight of C; 0.05-10% by weight of Mn; 1.2-1.65% by weight of Si and 0-0.5% by weight of Al or, alternatively, 1.2-1.65% by weight of Al and 0-0.5% by weight of Si; 0.7-1.8% by weight of Cr; 0.2-0.3% by weight of Mo; 3.0-3.6% by weight of Ni; the remainder being iron and inevitable impurities.

8. The method according to claim 1, wherein the composition of the steel in weight further comprises the following elements: S: 0-0.005%; P: 0-0.015%; O: 0-0.005%; Ca: 0-0.003%; N: 0-0.01%; Cu: 0-0.15%.

9. The method according to claim 8, wherein the composition of the steel in weight comprises: 0.23-0.30% by weight of C; 0.05-0.7% by weight of Mn; 1.2-1.6% by weight of Si; 0.01-0.94% by weight of Al; 0.7-14% by weight of Cr; 0.2-0.3% by weight of Mo; 2.0-3.6% by weight of Ni; 0-0.003% by weight of S; 0-0.015% by weight of P; 0-0.0015% by weight of I, 0-0.002% by weight of Ca; 0-0.0080% by weight of N; 0-0.15% by weight of Cu; balanced iron save for incidental impurities.

10. A high strength seamless steel pipe for OCTG applications having a composition comprising:

0.2-0.4% by weight of C;
0.05-1.5% by weight of Mn;
1.0-2.0% by weight of Si and 0-0.5% by weight of Al or, alternatively, 1.0-2.0% by weight of Al and 0-0.5% by weight of Si;
0.5-2.0% by weight of Cr;
0.2-0.5% by weight of Mo;
2.0-3.7% by weight of Ni;
0-0.005% by weight of S;
0-0.015% by weight of P;
0-0.005% by weight of O;
0-0.003% by weight of Ca;
0-0.01% by weight of N;
0-0.15% by weight of Cu;
the balance being iron and incidental impurities;

wherein the steel has a mainly cementite-free bainitic microstructure and displays a yield strength of at least 140 ksi and a transversal toughness at room temperature of at least 50 J.

11. The high strength seamless steel pipe according to claim 10, wherein the steel displays a yield strength of at least 170 ksi.

12. The high strength seamless steel pipe according to claim 10, wherein the steel has a transversal toughness at 24° C. of at least 69-75 J.

13. The high strength seamless steel pipe according to claim 12, wherein the steel has a transversal toughness at 0° C. of at least 58-68 J.

14. The high strength seamless steel pipe according to claim 13, wherein the steel has a transversal toughness at −20° C. of at least 49-52 J.

15. The high strength seamless steel pipe according to claim 10, wherein the composition comprises:

0.23-0.30% by weight of C;
0.05-1.0% by weight of Mn;
1.2-1.65% by weight of Si and 0-0.5% by weight of Al or, alternatively, 1.2-1.65% by weight of Al and 0-0.5% by weight of Si;
0.7-1.8% by weight of Cr;
0.2-0.3% by weight of Mo;
3.0-3.6% by weight of Ni;
0-0.005% by weight of S;
0-0.015% by weight of P;
0-0.002% by weight of O;
0-0.003% by weight of Ca;
0-0.01% by weight of N;
0-0.1% by weight of Cu;
the balance being iron and incidental impurities.

16. The high strength seamless steel pipe according to claim 10, wherein Ni+2Mn is between 2.1 and 3.9% in weight.

17. A method for producing an article intended for OCTG applications comprising:

forming a high strength mainly cementite-free bainitic steel with a composition comprising:

0.2-0.4% by weight of C;
0.05-1.5% by weight of Mn;
1.0-2.0% by weight of Si and 0-0.5% by weight of Al or, alternatively, 1.0-2.0% by weight of Al and 0-00.5% by weight of Si;
0.5-2.9% by weight of Cr;
0.2-0.5% by weight of Mo;
2.0-3.7% by weight of Ni;
0-0.005% by weight of S;
0-0.015% by weight of P;
0-0.005% by weight of O;
0-0.003% by weight of Ca;
0-0.01% by weight of N;
0-0.15% by weight of Cu;
the balance being iron and incidental impurities; and manufacturing an article for OCTG applications from the high strength mainly cementite-free bainitic steel and wherein the manufactured article has a transversal toughness that satisfies one or more of the following: a transversal toughness at 24° C. of at least 69-75 J, a transversal toughness at 0° C. of at least 58-68 J, and a transversal toughness at −20° C. of at least 49-52 J.

18. The method according to claim 17, wherein Ni+2Mn is between 2.1 and 3.9% in weight.

19. The method according to claim 17, wherein the steel comprises greater than 3% by weight of Ni.

20. The method according to claim 1, wherein the steel comprises greater than 3% by weight of Ni.

21. The high strength seamless steel pipe according to claim 10, wherein the steel comprises greater than 3% by weight of Ni.

22. The method according to claim 3, wherein the steel is cooled with an average cooling rate between 0.10 and 1.0° C. per second.

23. The method according to claim 22, wherein the average cooling rate is between 0.2 and 0.5° C. per second.

* * * * *

UNITED STATES PATENT AND TRADEMARK OFFICE

CERTIFICATE OF CORRECTION

PATENT NO. : 8,328,960 B2
APPLICATION NO. : 12/743801
DATED : December 11, 2012
INVENTOR(S) : Gomez et al.

It is certified that error appears in the above-identified patent and that said Letters Patent is hereby corrected as shown below:

In the Specifications:

In column 2 at line 10, Change “Mn,” to --Mn;--.

In column 2 at line 14, Change “Ni,” to --Ni;--.

In column 2 at line 32, Change “Mn,” to --Mn;--.

In column 2 at line 36, Change “Ni” to --Ni;--.

In column 2 at line 37, Change “P,” to --P;--.

In column 12 at line 50, Change “Or” to --Cr--.

In the Claims:

In column 12 at line 62, In Claim 1, before “A” delete “Process”.

In column 13 at line 42, In Claim 7, change “10%” to --1.0%--.

In column 13 at line 54, In Claim 9, change “0.94%” to --0.04%--.

In column 13 at line 54, In Claim 9, change “14%” to --1.4%--.

In column 13 at line 57, In Claim 9, change “I,” to --O,--.

In column 14 at line 53, In Claim 17, change “00.5%” to --0.5%--.

In column 14 at line 55, In Claim 17, change “2.9%” to --2.0%--.

In column 14 at line 66, In Claim 17, change “steel” to --steel;--.

Signed and Sealed this
Twenty-fifth Day of June, 2013

Teresa Stanek Rea
*Acting Director of the United States Patent and Trademark Office*